US006188318B1

(12) United States Patent
Katz et al.

(10) Patent No.: US 6,188,318 B1
(45) Date of Patent: Feb. 13, 2001

(54) DUAL-TECHNOLOGY INTRUSION DETECTOR WITH PET IMMUNITY

(75) Inventors: Fred Katz, Hauppauge; Eugene Marder, Forest Hills, both of NY (US)

(73) Assignee: Pittway Corp., Chicago, IL (US)

( * ) Notice: Under 35 U.S.C. 154(b), the term of this patent shall be extended for 0 days.

(21) Appl. No.: 09/342,082

(22) Filed: Jun. 29, 1999

(51) Int. Cl.[7] ..... E05B 45/06

(52) U.S. Cl. ..... 340/545.3; 340/552; 340/506; 340/554; 340/541; 340/567; 340/573

(58) Field of Search ..... 340/545.3, 522, 340/506, 554, 541, 567, 573

(56) References Cited

U.S. PATENT DOCUMENTS

| | | | | |
|---|---|---|---|---|
| 3,872,449 | | 3/1975 | Scheidweiler | 340/228.7 |
| 4,028,690 | | 6/1977 | Buckley et al. . | |
| 4,297,684 | | 10/1981 | Butter | 340/557 |
| 4,660,024 | * | 4/1987 | McMaster | 340/522 |
| 4,746,906 | * | 5/1988 | Lederer | 340/522 |
| 4,857,912 | | 8/1989 | Everett, Jr. et al. | 340/825.3 |
| 4,864,136 | * | 9/1989 | Behlke | 250/338.3 |
| 5,017,906 | * | 5/1991 | Pantus | 340/517 |
| 5,077,548 | * | 12/1991 | Dipoala | 340/522 |
| 5,107,249 | | 4/1992 | Johnson | 340/541 |
| 5,126,718 | | 6/1992 | Doctor | 340/567 |
| 5,155,468 | | 10/1992 | Stanley et al. | 340/501 |
| 5,444,432 | * | 8/1995 | Pildner et al. | 340/567 |
| 5,471,194 | | 11/1995 | Guscott | 340/511 |
| 5,473,311 | | 12/1995 | Hoseit | 340/573 |
| 5,499,016 | | 3/1996 | Pantus | 340/555 |
| 5,504,473 | | 4/1996 | Cecic et al. | 340/541 |
| 5,581,236 | | 12/1996 | Hoseit et al. | 340/511 |
| 5,612,674 | | 3/1997 | Tice | 340/517 |
| 5,640,143 | | 6/1997 | Myron et al. | 340/541 |
| 5,670,943 | | 9/1997 | DiPoala et al. | 340/567 |
| 5,736,928 | | 4/1998 | Tice et al. | 340/511 |
| 5,764,142 | | 6/1998 | Anderson et al. | 340/511 |
| 5,798,701 | | 8/1998 | Bernal et al. | 340/628 |
| 5,831,524 | | 11/1998 | Tice et al. | 340/506 |
| 5,870,022 | | 2/1999 | Kuhnly et al. | 340/567 |

* cited by examiner

*Primary Examiner*—Daniel J. Wu
*Assistant Examiner*—Tai T. Nguyen
(74) *Attorney, Agent, or Firm*—Greenberg Traurig, LLP; Anthony R. Barkume

(57) ABSTRACT

A dual-sensing intrusion detection device for detecting an intruder comprising a PIR sensor and a microwave sensor. The device comprises PIR processing means and microwave processing means, means for summing the processed PIR signal with the processed microwave signal to generate a summed signal, and means for comparing the summed signal to a sum threshold value to determine if an alarm condition exists. The sum threshold value is selected for optimal discrimination between a human intruder and an animal presence. An additional feature of the intrusion detection device is the generation of a PIR difference signal. This feature allows the device to compensate for the limited bandwidth of the PIR sensor and to be more sensitive to a human intruder. The processing of the sensor signals includes an integration technique that sums the amplitude values of the signal and causes the sum to decay at a slow rate. In addition, the slow decay rate causes the signal to be spread out in time, thereby allowing the signals from both detectors to be above the threshold at the same time.

56 Claims, 9 Drawing Sheets

DUAL-TECHNOLOGY INTRUSION DETECTOR WITH PET IMMUNITY

BACKGROUND OF THE INVENTION

This invention relates to an intrusion detection system and in particular to dual-technology detectors wherein the signals generated from a Passive Infra Red (PIR) sensor and a microwave sensor are processed to detect a human intruder and reject pets and other noise producing sources.

The use of dual-technology detectors in security systems is well known in the prior art. The dual-technology detectors produce a number of positive results including detection of trouble conditions, accurate adjustment of thresholds, and rejection of false alarms. Security systems of today typically use a combination of a PIR sensor, a microwave sensor, and/or an ultrasonic sensor to achieve these results. The detection of trouble conditions is achieved by using one type of sensor to detect an intruder and a second type of sensor as a redundant detector that allows the system to monitor the first sensor for accuracy in detecting the intruder. U.S. Pat. No. 5,504,473 discloses an intrusion detector of this type. Accurate adjustments of thresholds are achieved by using a second sensor with a low threshold value to adjust the threshold value of a first sensor. If the second sensor is constantly above its threshold, the threshold of the first sensor is increased. This type of adaptive threshold system allows the threshold of the first sensor to be as low as possible without producing false alarms. An event detection system with an adjustable threshold generator is disclosed by U.S. Pat. No. 5,471,194.

The most prevalent reason for using dual technology detectors is the rejection of false alarms, which may be generated by environmental factors, electrical noise, or pets. Security systems that use dual technology sensors to reject false alarms require both sensors to detect an event before an alarm is generated. The dual sensors reduce false alarms due to environmental factors because both sensors will detect an intruder, but only one sensor will react to an event produced by the environment. For instance, a PIR sensor, which detects changes in temperature, will detect the heating system being turned on, but a microwave sensor will not detect the change in temperature, and therefore there will be no alarm condition. The dual sensors also reduce false alarms due to spurious noise because the noise is typically random and is less likely to occur in both sensors at the same time. Lastly, reduction of false alarms due to pets is dependent on the field of view of the two sensors and the setting of the threshold levels of the comparators. An animal presence is different from a human intruder in that the animal is lower to the ground and the temperature of the animal is lower due to its skin being covered with hair. The dual sensors of the prior art discriminate between an animal and a human by having one sensor's field of view above the floor by a few feet and setting the threshold level of the comparator to a value that is exceed by a signal generated from a human intruder, but not exceeded by a signal generated from an animal presence. In this system the sensor with the higher field of view would not detect the pet and therefore not cause an alarm condition. U.S. Pat. No. 5,670,943 discloses an intruder detector of this type. Unfortunately, this method may false alarm on pets that are very large or that have very little hair and may not alarm on intruders that are low to the ground.

The rejection of false alarms is accomplished by looking for a signal to be produced from both detectors at the same time or in a sequence of time. In some prior art systems, such as U.S. Pat. No. 5,107,249, the output of each detector is fed to separate comparator circuits where the detector outputs are compared to threshold values and the comparator outputs are a high level when the detector outputs are above the thresholds. The comparator outputs are logically ANDed to produce an alarm. If either detector signal is not above its threshold, or the signals do not occur simultaneously, the alarm is not sounded. In other prior art systems, such as U.S. Pat. No. 5,581,236, the time between each comparator output signal is checked to occur within a certain limit. These systems are an improvement over the other prior art systems because they allow for difference due to the sensors' detection rates and differences in the sensors' field of view.

The problem with these systems is that they do not account for differences in the signal strength due to the trajectory of the intruder. Certain trajectories cause one detector to have a high output signal while the other detector will have a minimal output signal. For instance, if an intruder is walking directly towards a PIR sensor, the sensor will be less likely to detect a change in temperature than if the intruder walked in, across, and out of the zone the sensor was covering. In this system the PIR would not detect the intruder, while the microwave sensor would have a strong signal that would not cause an alarm condition.

It is therefore an object of the present invention to provide an intrusion detection system that uses dual sensors to detect human intrusions and reject false alarms due to pets and other noise producing sources.

It is a further object of the present invention to provide an intrusion detection system that will alarm when a high signal is present in one sensor and a low signal is present in the other sensor.

It is still a further object of the present invention to provide an intrusion detection system that distinguishes between a human intruder and a pet presence by processing the signals from both detectors using a microprocessor.

It is still a further object of the present invention to provide an intrusion detection system that may be customized to take into account the trajectory patterns at an installation site.

It is a further object of the present invention to provide an intrusion detection system that may be customized to reject a customer's pet.

SUMMARY OF THE INVENTION

In accordance with these and other objects, the present invention is a dual-sensing intrusion detection device for detecting an intruder in a volume of space comprising a PIR sensing means and a microwave sensing means. The device comprises PIR processing means and microwave processing means, means for summing the processed PIR signal with the processed microwave signal to generate a summed signal, and means for comparing the summed signal to a sum threshold value to determine if an alarm condition exists. The sum threshold value is selected for optimal discrimination between a human intruder and an animal presence. The summing of the signals is the basis of this invention and allows for a strong signal in one sensor to compensate for a weak signal in the second sensor. This scenario occurs when an intruder moves in the volume of space at a trajectory that is difficult for one of the sensors to detect.

In one aspect of the invention, an additional feature of the intrusion detection device is the generation of a PIR difference signal. This signal is the first derivative of the PIR signal and is an indication of the speed of the intruder. This feature allows the device to compensate for the limited bandwidth of the PIR sensor. The PIR difference signal is processed in the same manner as the PIR and microwave signals and is summed with the processed PIR and microwave signals prior to the threshold comparison.

In a second aspect of the invention, in addition to the summing of the sensor signals, an important feature of the present invention is the particular processing of the sensor signals prior to summing the sensor signals, as described in detail below. In particular, the processing is an integration technique that sums the amplitude values of a particular sensor signal and causes the sum to decay at a slow rate. This type of integration technique may also be considered a filtering technique because the random noise is smoothed out. In addition, the slow decay rate causes the signal to be spread out in time, thereby allowing the signals from both detectors to be above the threshold at the same time.

The processing of the sensor signals may be performed in two different ways. The first way, which is the preferred embodiment of the present invention, uses a micro-controller to process the PIR and microwave signals and determine when to generate an alarm signal. In this digital embodiment, the micro-controller samples the PIR sensor signal and the microwave sensor signal by performing an analog-to-digital (A/D) conversion. The A/D conversion is at a higher frequency for the microwave signal because of its frequency content, although the rates may be the same for both detectors. The micro-controller then generates the PIR difference signal by determining the difference between a current sample of the detected PIR signal and a prior sample of the detected PIR signal. The micro-controller then performs the steps of the integration algorithm for the PIR signal, the microwave signal and the PIR difference signal. The integration algorithm is comprised of the following steps: subtracting a first threshold value from the digital signal, determining the absolute value of the digital signal minus the first threshold value, comparing the absolute value of the digital signal minus the first threshold value to a second threshold value, generating an increase in the processed signal when the absolute value of the digital signal minus the first threshold value is greater than the second threshold value, and generating a decrease in the processed signal when the absolute value of the digital signal minus the first threshold value is less than the second threshold value. The increase in the processed signal is a percentage of the absolute value of the digitized input signal minus the first threshold and the decrease in the processed signal is a percentage of a prior value of the processed signal.

The second way of processing the sensor signals uses analog circuits comprising operational amplifiers, capacitors, resistors, summing circuits, and comparator circuits to process the PIR and microwave signals and determine when to generate an alarm signal. It is noted that the PIR difference signal is preferably not generated and processed in this embodiment. The analog circuit to perform the integration algorithm for the PIR and the microwave signals is comprised of an inverting amplifier to invert the signal, two diodes with cathodes tied together to sum the signal with the inverted signal, a resistor coupled to cathodes of the first and second diodes, a capacitor coupled to the resistor, and a second resistor coupled to the capacitor to discharge the capacitor.

Both, the first and second embodiments may also comprise means for comparing the detected microwave signal to a minimum microwave threshold value and means for comparing the detected PIR signal to a minimum PIR threshold value as an additional test to determine if an alarm condition exists.

Both, the first and second embodiments may also comprise means for multiplying the processed PIR signal, the processed difference PIR signal, and the microwave signal by an associated weighting factor prior to being summed. The weighting factors may be selected to customize the dual-sensing intrusion detection device for optimal detection of an intruder in a given volume of space. The value of the weighting factors may be selected prior to the device installation, or at the installation site. In order to select the weighting factors at the installation site, the installer would be require to input information into the device, possibly through settings of switches. Selection of the weighting factor prior to installation may be performed during manufacturing of the device. In the first (digital) embodiment the value is programmed into memory, and in the second (analog) embodiment the value is dependent on the gain of the op-amp circuits. Similarly, the sum threshold value may be selected and programmed to customize the dual-sensing intrusion detection device for discrimination against the owner's pet.

DETAILED DESCRIPTION OF THE PREFERRED EMBODIMENT

Figure 1:
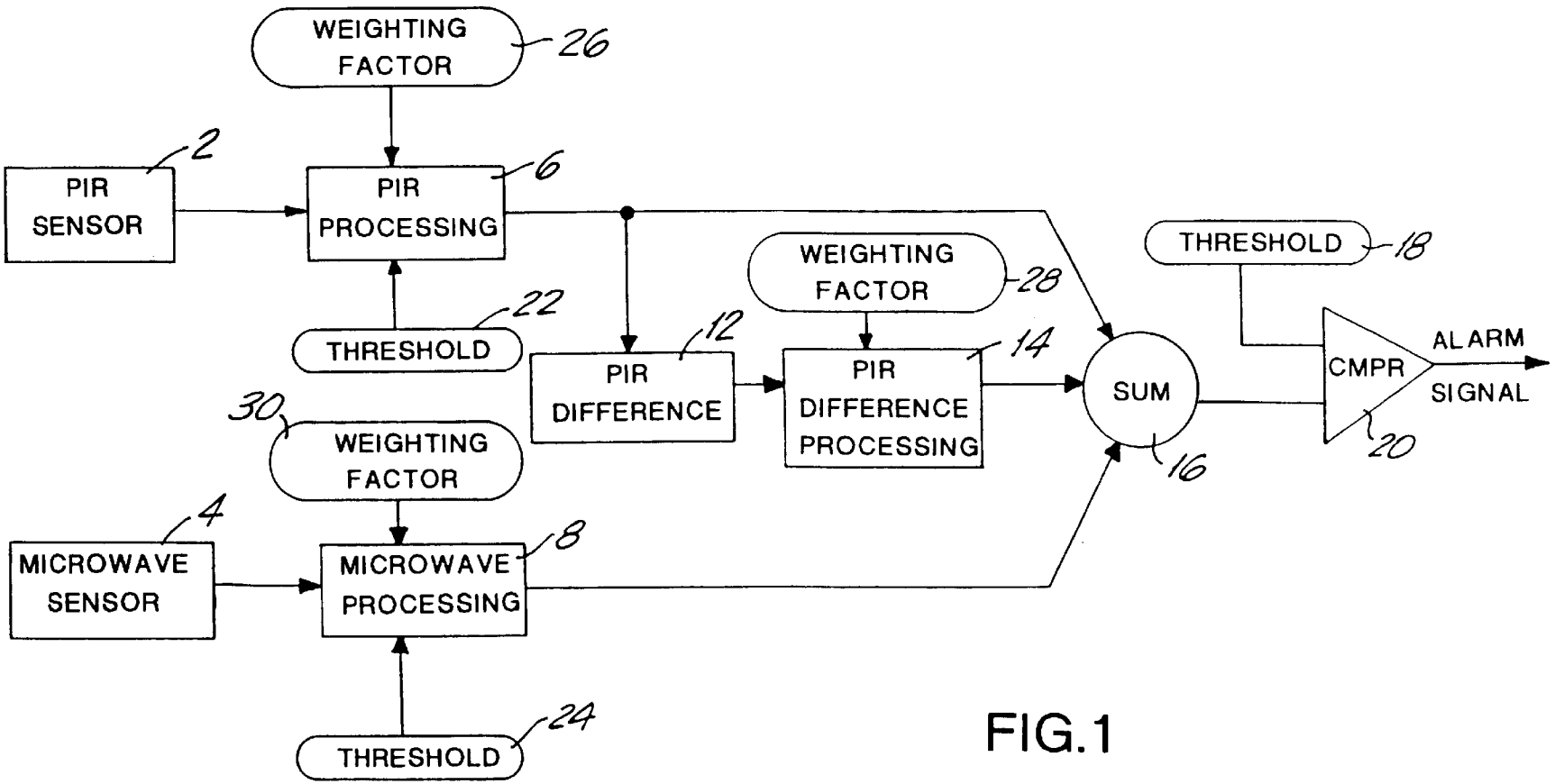
FIG. 1 is a block diagram of the overall functionality of the present invention.

Referring to FIG. 1, a functional block diagram of the preferred embodiment of a dual-tech intrusion detector device is shown. Functionally, the invention operates as follows: a PIR sensor 2 and microwave sensor 4 are configured in the device to view a substantially common field of view. The PIR sensor 2 generates a detected PIR signal that is processed by PIR processing means 6. Likewise, the microwave sensor 4 generates a detected microwave signal that is processed by microwave processing means 8. The processed PIR signal is then input to a PIR difference means 12, which operates to differentiate the data. The PIR difference signal is then input to a PIR difference processing means 14.

The processed PIR signal, processed PIR difference signal, and processed microwave signal are then input to a summing means 16 as shown in FIG. 1. The summing means 16 operates to calculate a sum of the three input signals, which is then compared to a threshold value 18 by comparator means 20. If the summed signal is greater then the threshold value 18, an alarm signal is generated; if the summed signal is less then the threshold value 18, the alarm signal is not generated. Thus, a relatively weak PIR signal may be compensated for by a relatively stronger microwave signal to indicate an alarm, or a relatively weak microwave signal may be compensated for by a relatively strong PIR signal to generate an alarm, etc.

In addition, various other thresholds may be used to ensure an alarm condition truly exists. For example, a PIR threshold 22 must be exceeded by the PIR signal, and a microwave threshold 24 must be exceeded by the microwave signal, in order to generate the alarm signal. This ensures that some minimum value must be attained for each of these sensors, regardless of the strength of the other sensor. For example, an alarm signal will not be generated by an exceedingly strong PIR signal if no activity is detected by the microwave signal (i.e.: the microwave signal fails to exceed the threshold value), and vice-versa.

In addition, the device allows the user to customize the relative weights given to the PIR signal, the PIR difference signal, and the microwave processing signal via a PIR weighting factor 26, a PIR difference weighting factor 28, and a microwave weighting factor 30, respectively, as shown in FIG. 1 and explained in detail with reference to the detailed embodiments below.

Figure 1A:
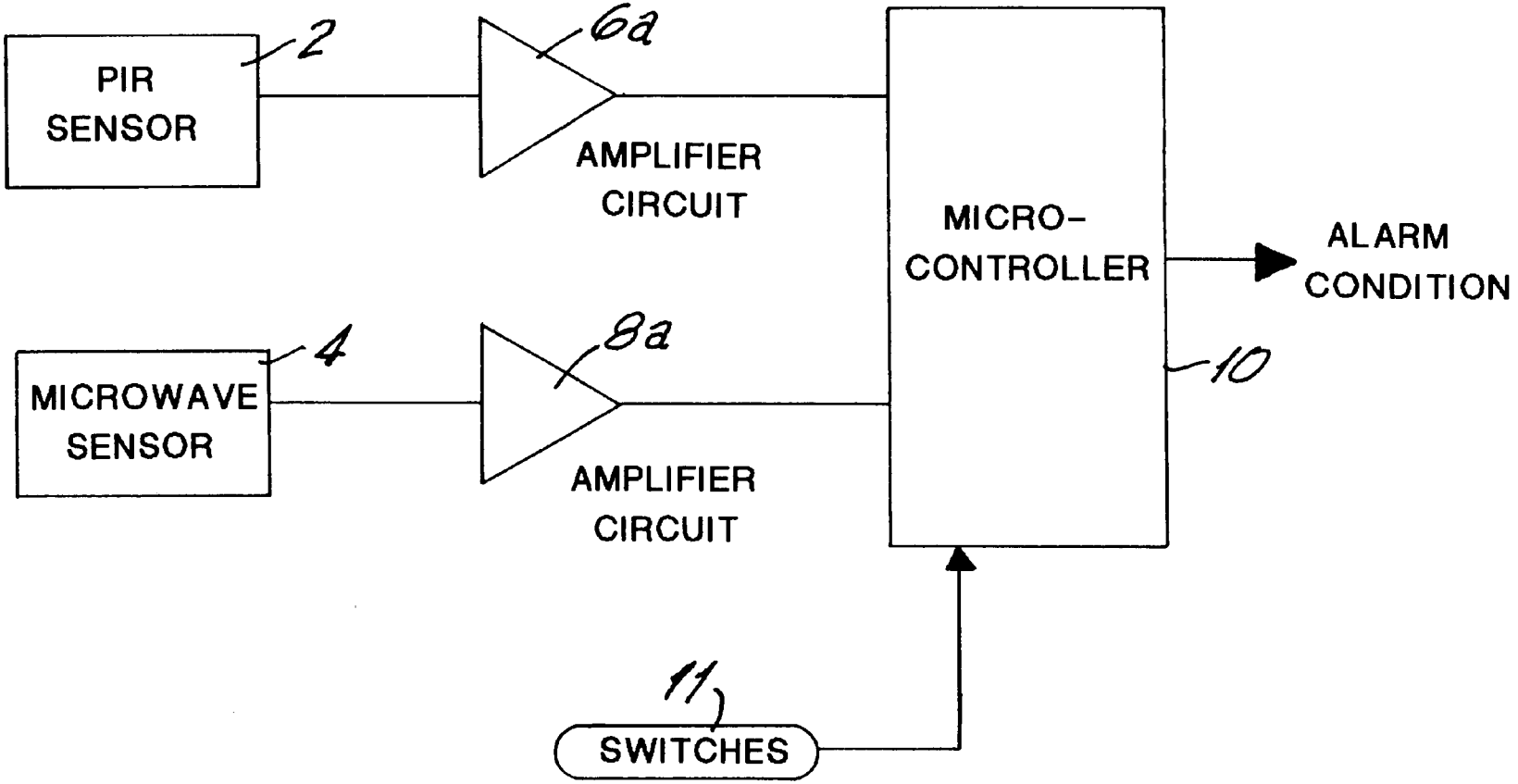
FIG. 1(A) is a top-level block diagram of the first (digital) embodiment of the present invention.

The processing of the detected PIR signal, the PIR difference signal, and the detected microwave signal is performed by either digital or analog means to execute an integration function. The preferred embodiment of this device operates in a substantially digital domain, i.e. by use of a micro-controller, to accomplish the function as outlined above as shown in FIG. 1. FIG. 1(A) and (B) in particular illustrates this digital-based device. Thus, the processing of the sensed signal from the PIR sensor 2 and the microwave sensor 4 is performed by amplifier circuits 6*a* and 8*a* and, by a micro-controller 10. The amplifier circuits 6*a* and 8*a* are ac coupled and have a gain response that is greater for higher frequencies in order to take into account the reaction time (bandwidth) of the sensors. As shown in FIG. 1(*b*), the micro-controller 10 converts the two input signals to digital signals using an embedded 8 bit A/D converter 40, thereby producing a single count for each 20 millivolts of the input signal. The A/D converter 40 samples the PIR signal at a 25 Hz rate and the microwave signal at a 250 Hz rate. The frequency content of the microwave signal causes it to be sampled and processed ten times faster than the PIR signal. The micro-controller 10 continually processes the digital signal from the microwave sensor and on the tenth iteration it processes the digital signal from the PIR sensor and then determines if an alarm condition is present. If an alarm condition is present, the micro-controller 10 generates an alarm signal.

Figure 2:
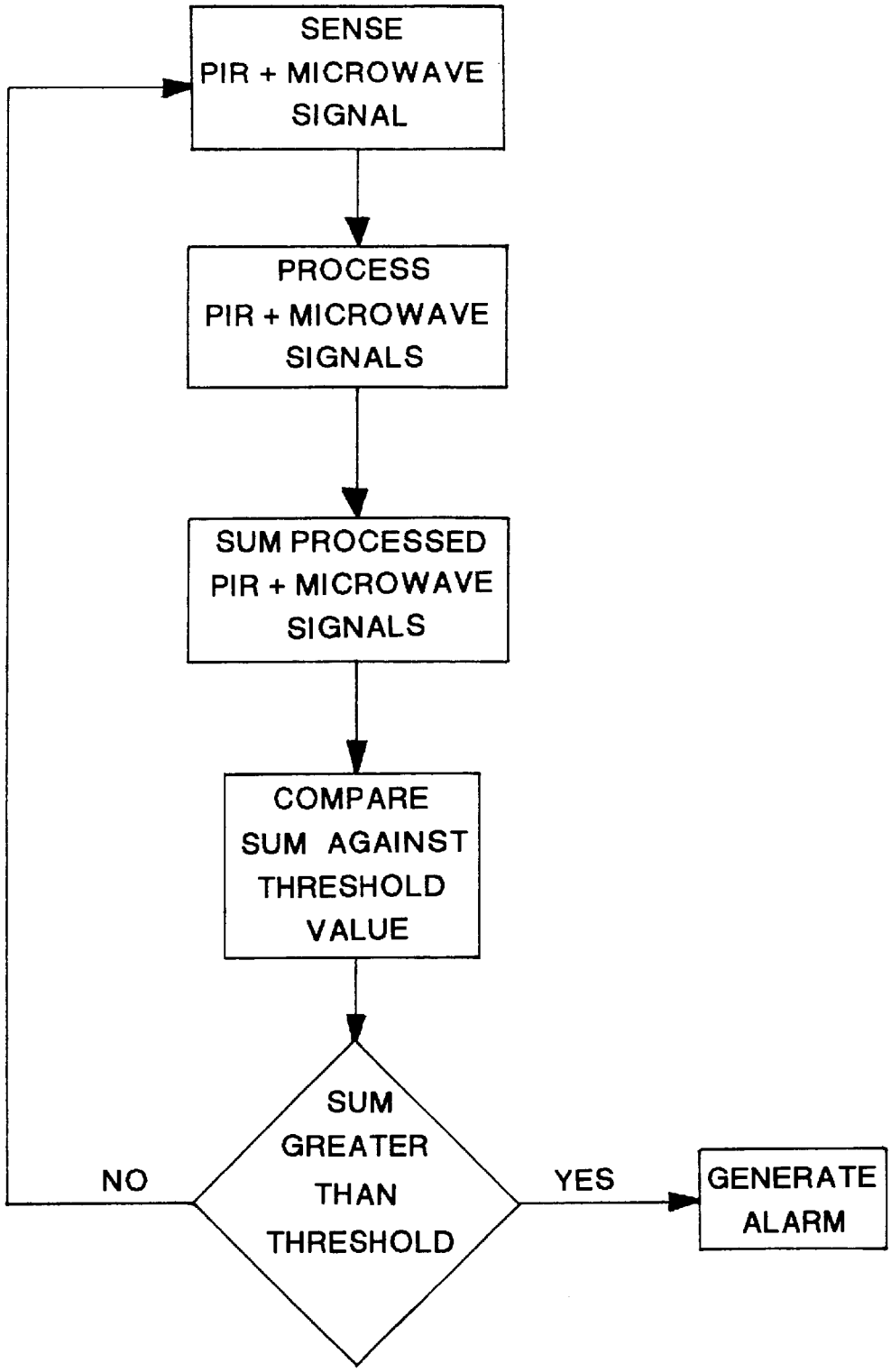
FIG. 2 is a top-level flow diagram of the preferred embodiment of the present invention.

FIG. 2 shows a top level flowchart for processing the signals as further illustrated in FIG. 1(*b*). The PIR and microwave signals are sensed by the detectors 2 and 4 and processed by the amplifier circuits 6*a* and 8*a* and the micro-controller 10. In order to determine if an alarm condition is present the micro-controller 10 sums the processed signals by summing block 48 and compares with compare block 54 the summed result to a sum threshold value 50. If the summed result is greater than the sum threshold, an alarm signal is generated. If the summed result is not greater than the sum threshold, the process is performed again. The sum threshold has been selected to discriminate any signals generated by the presence of a pet from signals generated by a human intruder. In the preferred embodiment this value is 160 counts (where one count is equivalent the least significant bit of the A/D converter) and has been selected by empirical analysis.

Figure 3:
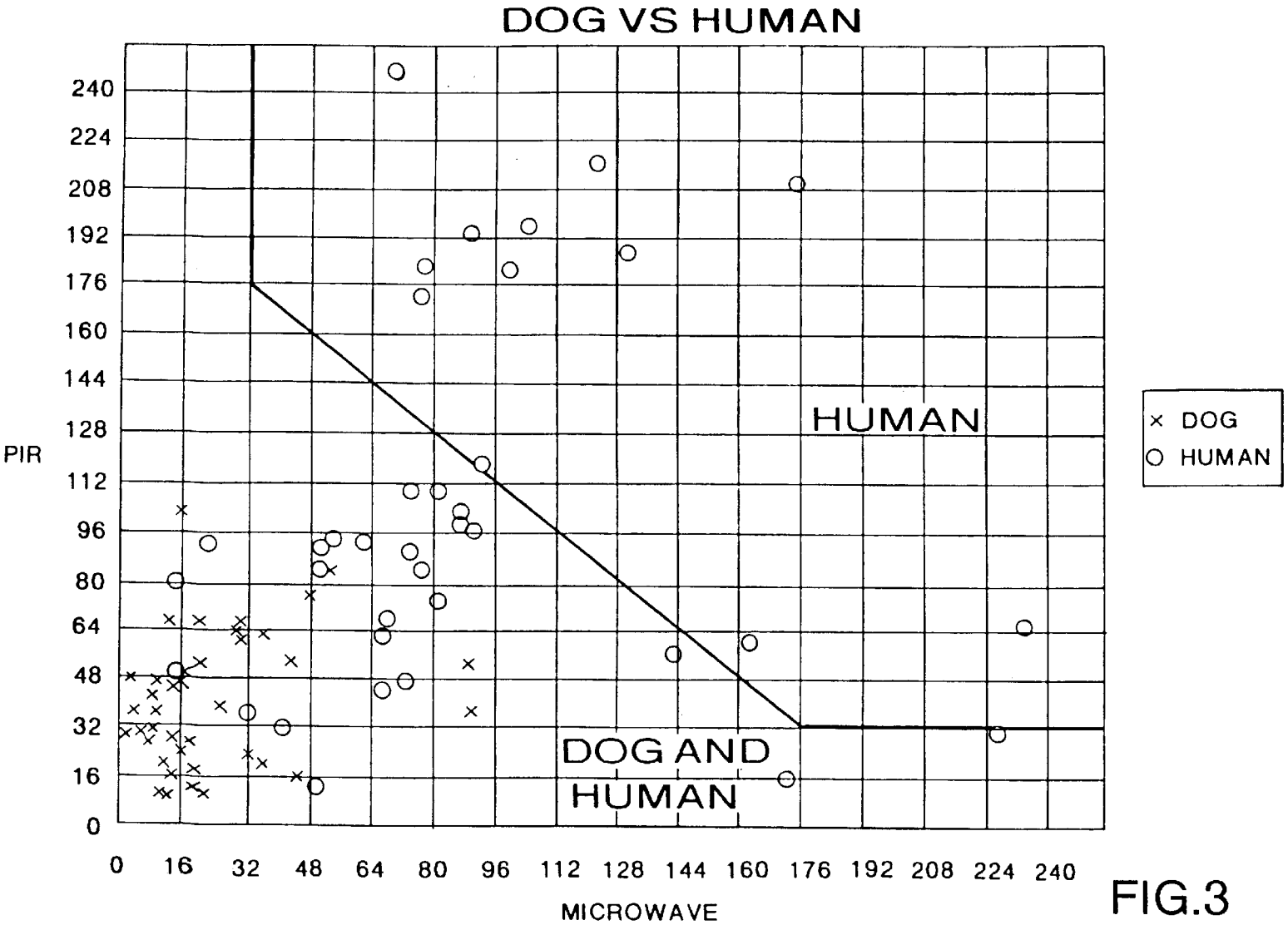
FIG. 3 is a graph that shows the signal levels generated by a dog and human from a PIR sensor and a microwave sensor when the dog and the human move through the volume of space at different trajectories.

In order to determine an optional sum threshold value 50, a database was generated from a multitude of different pets walking through a field of view of a dual-technology detector at different trajectories, and from a number of humans walking through the same field of view at different trajectories. FIG. 3 shows an example of a graph of the signal amplitude of the PIR sensor 2 vs. the signal amplitude of the microwave detector 4. A number of the results of a human and a pet walking through the different trajectories is shown; the human intruder is shown as Os and the pets are shown as Xs. The sum threshold (indicated by the solid line in FIG. 3) is selected to discriminate against all pet presence. That is, if the summed value is greater than the threshold function shown in FIG. 3, than the device will signal an alarm since it is highly likely to be a human (because no dogs were detected in that range). Although the human intruder will not be detected in some of the instances as shown, as he moves through the field of view of the detectors, his signal will eventually be great enough to cause the sum signal to be above the sum threshold value, thereby creating an alarm condition.

Figure 1B:
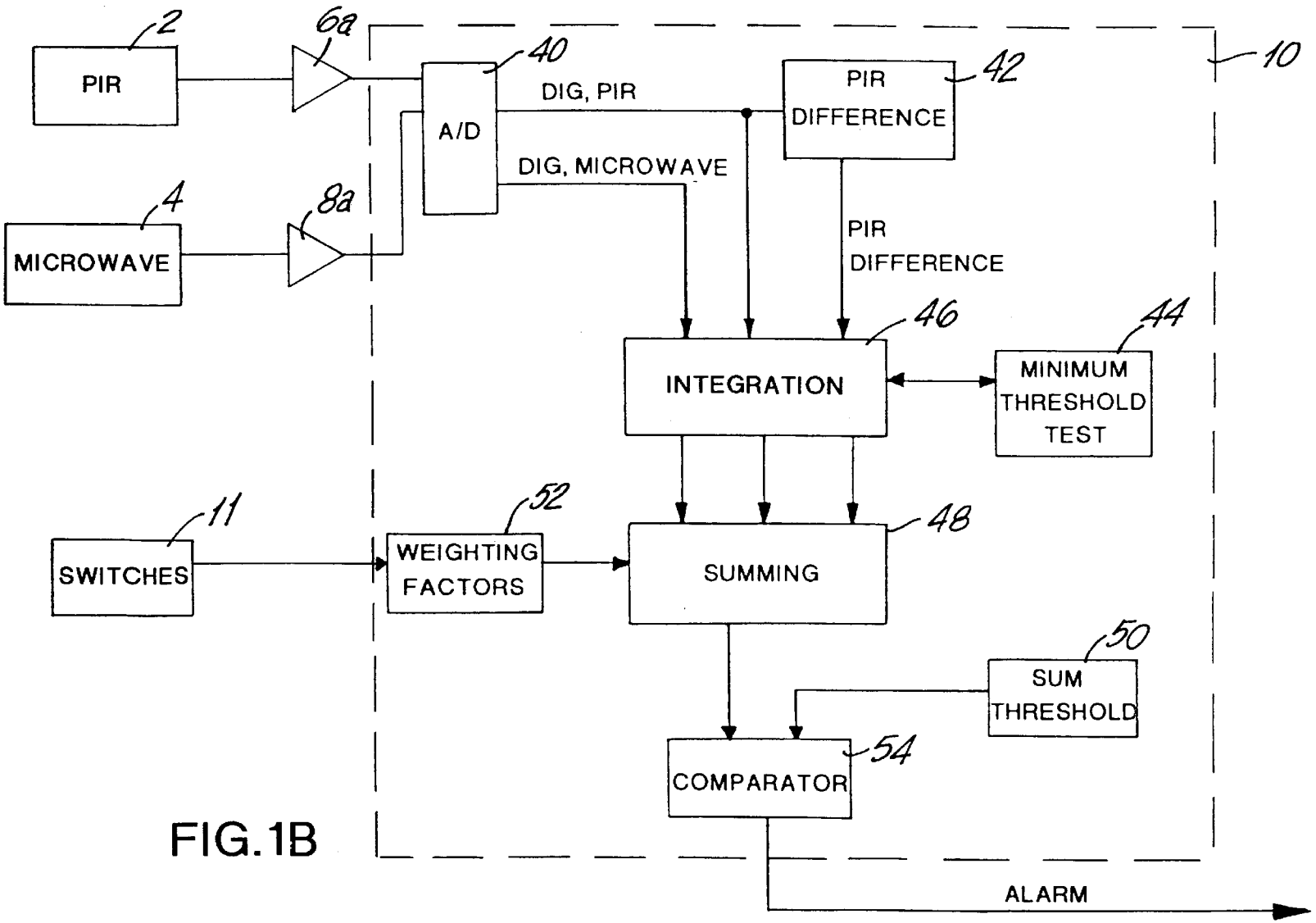
FIG. 1(B) is a detailed block diagram of the digital device of FIG. 1(A).
Figure 4:
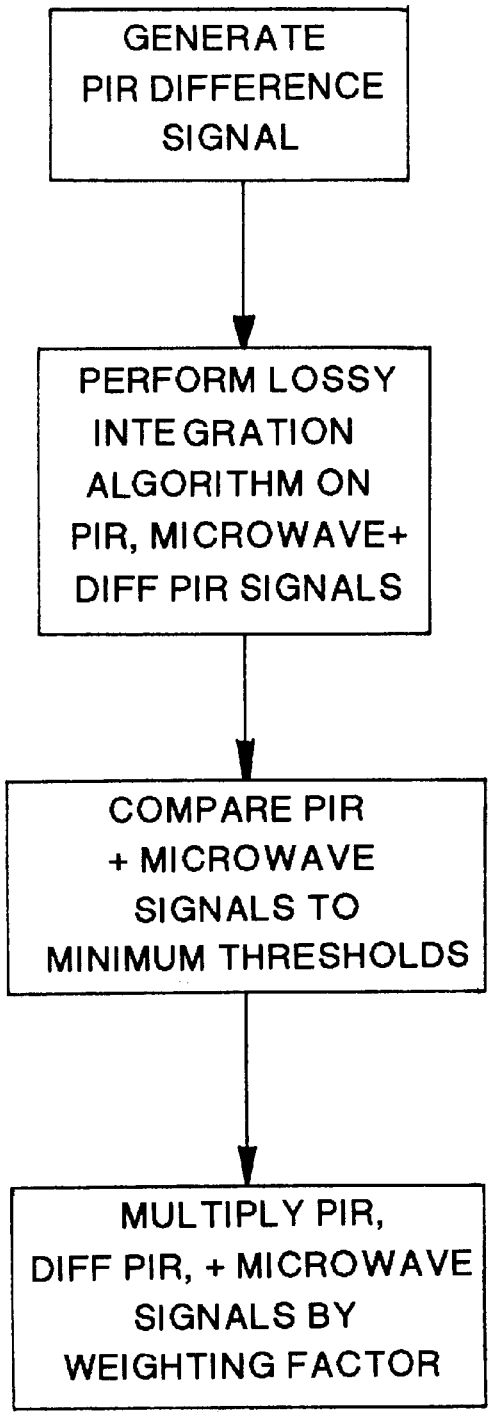
FIG. 4 is a processing flow diagram of the preferred embodiment of the present invention.

In addition to the processing described above, the micro-controller 10 performs several other processing algorithms prior to summing the signals. They are shown in the flowchart of FIG. 4 and the diagram in FIG. 1(B). The micro-controller 10 generates a difference PIR signal via PIR difference function 42 by subtracting a previous sample of the PIR signal from the present sample of the PIR signal and storing the result. The difference PIR signal goes through the same integration processing 46 as the PIR and microwave signals and is summed with the PIR and microwave signals at summing block 48 to determine if there has been an intrusion. The difference PIR signal is used to compensate for the slow reaction rate of the PIR sensor 2.

The micro-controller 10 performs the lossy integration algorithm 46 on the sampled PIR signal, the microwave signal, and the difference PIR signal. The lossy integration algorithm definition is as follows:

```
If Absolute Value (Data_In - Threshold_1) > Threshold_2
    THEN
Data_Out (new) = Data_Out + Absolute Value (Data_In -
                                Threshold_1)/Div_1
    ELSE
Data_Out (new) = Data_Out × (1 − (1/Div_2))
Where:
        Data_In = The digitized input voltage of a sample
(the digitized microwave signal, the digitized PIR signal, or
the PIR difference signal, as appropriate).
        Data_Out = The stored result of the previous
                                Data_Out calculation.
        Data_Out (new) = The newly calculated value of
                                Data_Out.
```

In addition, each signal is processed with different constant values, which are also shown in table 1.

TABLE 1

| | PIR SENSOR | MICROWAVE SENSOR | PIR DIFFERENCE |
|---|---|---|---|
| Div. 1 | 8 | 16 | 2 |
| Div. 2 | 8 | 32 | 128 |
| Threshold. 1 | 6 | 6–31 | 0 |
| Threshold. 2 | 28–60 | 8 | 8 |

The values of Table 1 have been selected through empirical analysis of the human and pet trajectory database described above. These values were selected to cause the signal from the PIR sensor 2 to be available to the summing block 48 at the same time as the signal from the microwave sensor 4 and to cause the signals generated by a human to become stronger and the signals generated by a pet to become weaker. This happens because the algorithm coefficients and constants have been empirically matched for multiple human and pet trajectories and their valves have been individually optimized to enhance valves associated with humans and minimize valves with dogs. This has been performed over a large data set of trajectories and velocities. Subtle differences in energy signatures projected by humans and dogs are exploited by this algorithm in such a way as to produce large differences in the processed result between pets and humans. Based on such items as cross-sectional profile, gait, exposed surface, and a multitude of other reasons, subtle differences can be processed to produce large indications for target identification and classification. The lossy integration and channel summation produces a cross-channel correlation function between IR and microwave. This two dimensional analysis yields much larger data product for humans over pets.

As can be seen, the second threshold value of the PIR sensor varies from 28 to 60 and is dependent on the ambient temperature, which is sensed by a thermistor (this temperature compensation is well known in the art). The first threshold value of the microwave sensor also varies from 6–31 and is dependent on the number of times the microwave signal is above its threshold while the PIR signal is not above its threshold. The adjustment of the microwave threshold is a known prior art technique of limiting the false alarms due to noise generated in one sensor.

As shown in the lossy integration equation, the algorithm subtracts a first threshold value from the signal sample. The first threshold value is equivalent to an offset bias. Next the absolute value of the signal sample minus the first threshold value is determined. The absolute value is compared against a second threshold value and if it is greater, the output data of the present sample is equal to the output of the previous sample plus the absolute value of the signal sample minus the first threshold value divided by a first divisor value. The first divisor value determines the percentage of the present sample to add to the last sample. If the absolute value is not greater than the second threshold value, the output data of the present sample is equal to the output of the previous sample multiplied by one minus one over a second divisor. The second divisor determines the decay rate of the signal sample.

The use of the lossy integration algorithm 46 with the technique of summing the sensor signals is advantageous over the prior art. The lossy integration algorithm causes the signals to "slide together", and the summing of the signals after the lossy integration algorithm processing allows the alarm threshold to be selected for a more accurate distinction between an animal presence and a human intruder. In addition, the use of the lossy integration algorithm with the summing technique allows the intrusion device to detect a human intruder that traverses almost any trajectory.

In addition to performing the lossy integration algorithm 46, the micro-controller 10 compares the PIR data output from the lossy integration algorithm 46 to a minimum threshold value which is equal to the first threshold value of the lossy integration algorithm 46 for the PIR signal (which is 6) via the minimum threshold test block 44. The micro-controller 10 also compares the microwave data output from the lossy integration algorithm 46 to a minimum threshold value, which is equal to the first threshold value of the lossy integration algorithm for the microwave signal (which is between 6 and 31) via the minimum threshold test block 44. If either of the lossy integration algorithm 46 outputs for these two signals is below a threshold, the alarm condition is not generated even if the sum of all three signals is above the sum threshold. This feature causes the dual-tech device to reject spurious noise that might be in one or both sensors.

The micro-controller 10 performs one additional task prior to summing of the three processed signals. The micro-controller 10 multiplies each output signal from the lossy algorithm by a weighting factor, which are stored and utilized in weighting factor block 52. In the preferred embodiment the weighting factor is 1. This value may be changed in order to make the output of one sensor more significant than the output of the other sensor. This is helpful in situations where the trajectory of something in the field of view of the sensors may be influenced by components in the field of view, such as a wall.

Figure 5A:
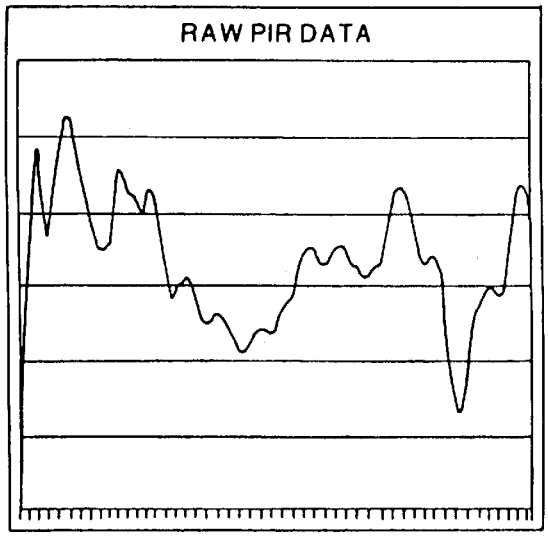
FIGS. 5 (A–F) are the raw and processed signals produced by a human.
Figure 5B:
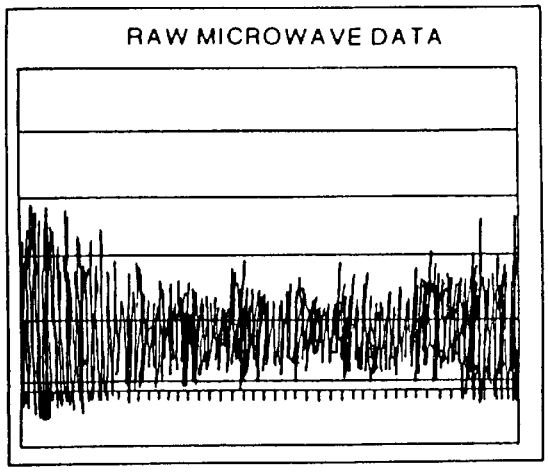
Figure 5C:
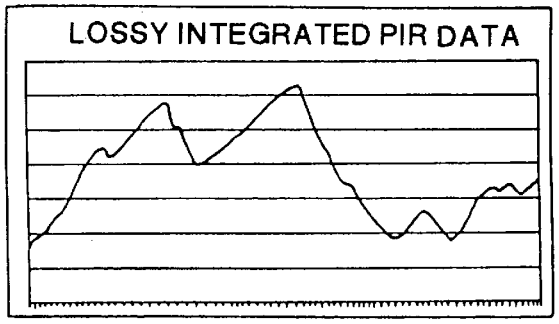
Figure 5D:
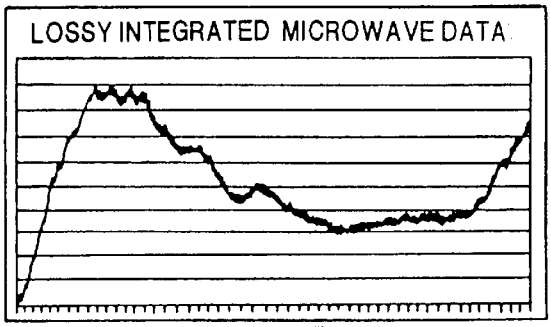
Figure 5E:
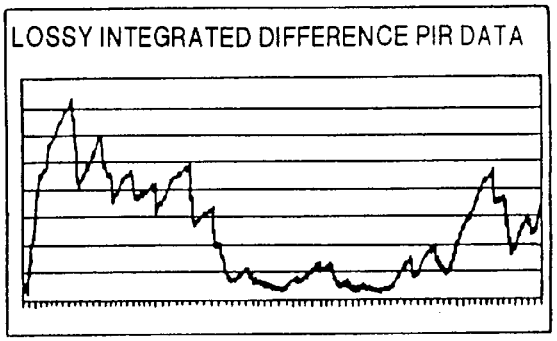
Figure 5F:
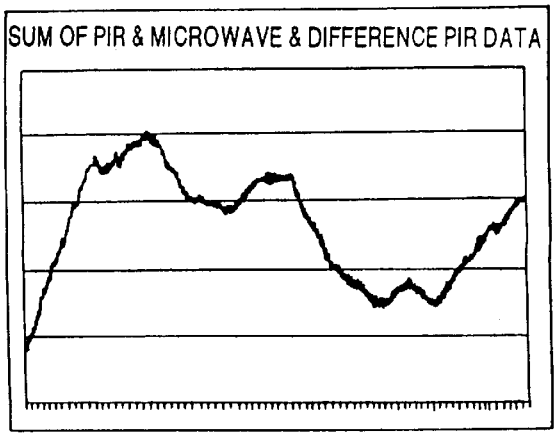
Figure 6A:
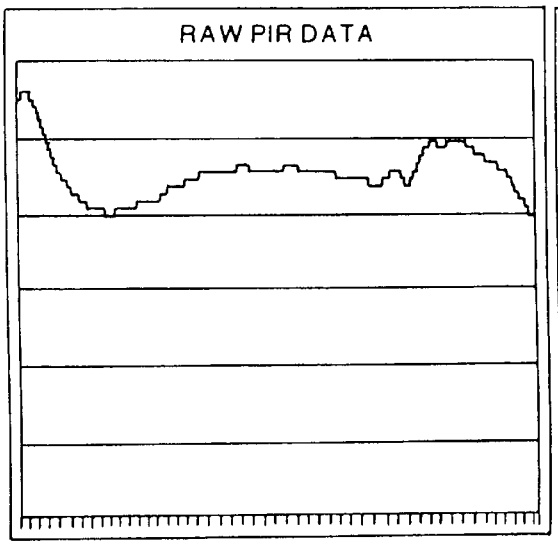
FIGS. 6 (A–F) are the raw and processed signals produced by a dog.
Figure 6B:
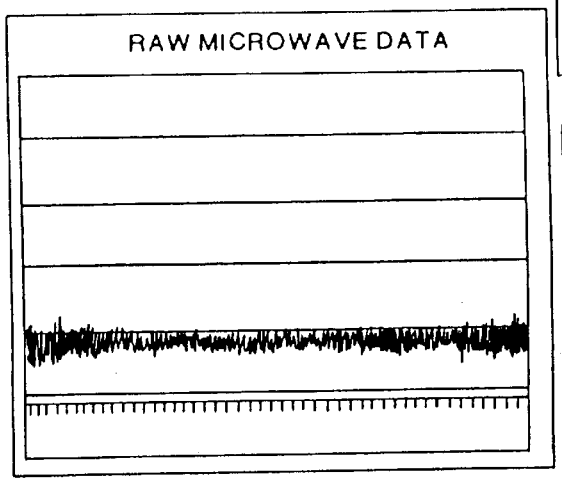
Figure 6C:
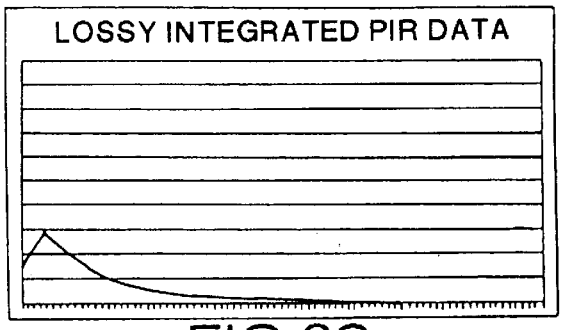
Figure 6D:
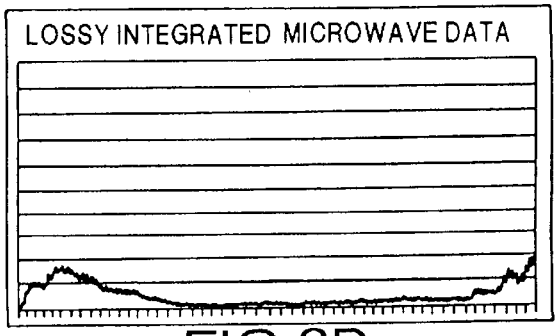
Figure 6E:
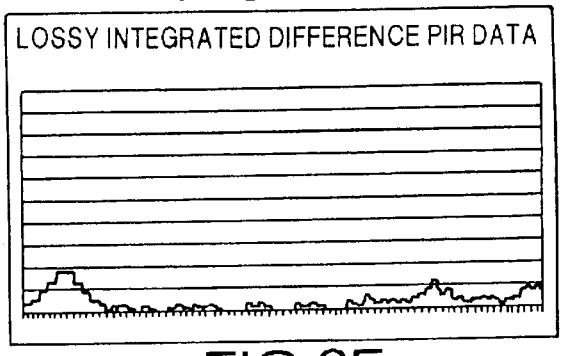
Figure 6F:
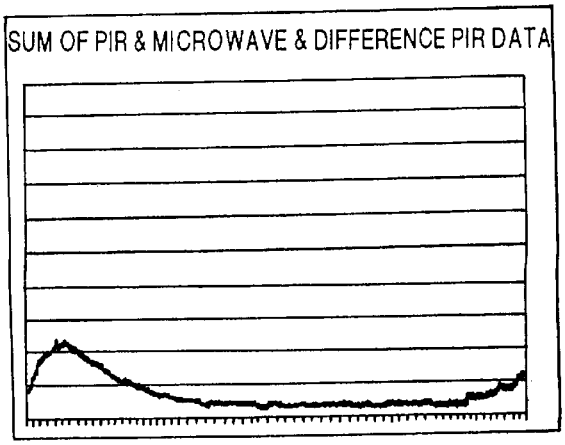

In order to demonstrate the processing results of the lossy integration algorithm 46, FIGS. 5A–F and FIGS. 6A–F are included. FIGS. 5A–F were generated by a human and FIGS. 6A–F were generated by a dog. FIGS. 5A and 6A are the outputs from the PIR sensor 2. FIGS. 5B and 6B are the outputs from the microwave sensor 4. FIG. 5C is the output of the lossy integration processing of the raw PIR signal of FIG. 5A. FIG. 5D is the lossy integration processing of the raw microwave signal of FIG. 5B. FIG. 5E is the lossy integration processing of the difference PIR signal, which was created from the raw PIR signal of FIG. 5A. FIG. 5F is the addition of the three signals in FIGS. 5C–5E. The signal in FIG. 5F is compared by comparison block 54 against the sum threshold value to determine if an alarm condition exists. FIG. 6C is the output of the lossy integration processing of the raw PIR signal of FIG. 6A. FIG. 6D is the lossy integration processing of the raw microwave signal of FIG. 6B. FIG. 6E is the lossy integration processing of the difference PIR signal, which was created from the raw PIR signal of FIG. 6A. FIG. 6F is the addition of the three signals in FIGS. 6C–6E. The signal in FIG. 6F is compared by comparison block 54 against the sum threshold value to determine if an alarm condition exists.

Figure 7:
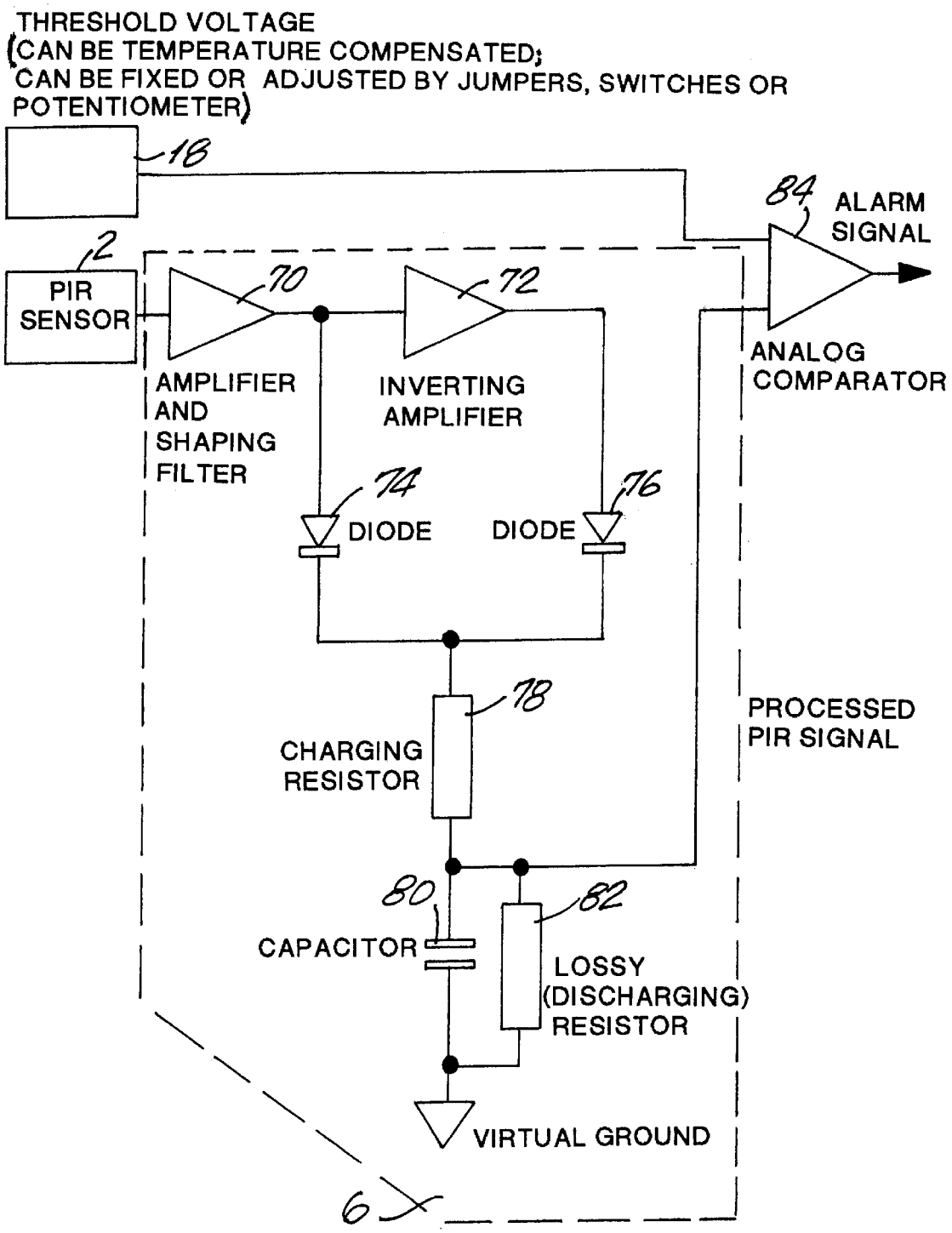
FIG. 7 illustrates the analog embodiment of the lossy integration function.

In a second embodiment of the invention, the functionality of the device illustrated in FIG. 1 is embodied with analog circuitry as shown in FIG. 7. The analog processing embodiment of the present invention operate as follows. The PIR sensor 2 generates a voltage waveform when a pet or human target traverses the Field of View (FOV) This voltage is applied to an amplifier 70 that is used to shape the frequency response of the detector. Lower end frequencies are de-emphasized which reduces sensitivity to pets, air currents, and higher end frequencies are boosted to increase the catch of fast human targets Frequencies higher than that necessary for human targets are allowed to roll of in order to reduce system noise sensitivity.

The amplifier output is inverted in the inverting amplifier 72. The outputs from amplifiers 70 and 72 are each Diode summed by Diodes 74 and 76 and their output is fed through a current limiting charging resistor 78. The charging current generated by the output of the charging resistor 78 is fed into capacitor 80, where a voltage may be gradually built up as a result of the charging current. This voltage is allowed to slowly discharge, via the lossy discharge resistor 82. The output of the capacitor 80 is applied to an analog comparator 84 and compared to a threshold voltage 18. If the capacitor's 80 output exceeds the threshold voltage 18, an alarm signal is generated. The capacitor 80/lossy resistor 82 combination may be returned to either actual ground or a virtual ground depending on the electronic requirements of the circuitry, for best noise immunity and component minimization. It is to be noted that the threshold voltage 18 can be temperature compensated, fixed or variable. The variable capability allows the user to program the sensor for varying degrees of detection sensitivity and false alarm immunity. This programming may be in the form of a switch, jumper or variable potentiometer.

Although the charge and discharge equations of FIG. 7 are not precisely equivalent to the algorithm, the circuit performs in the spirit of the algorithm, in the sense that signals exceeding the forward voltage of the Diodes 74 and 76 charge the capacitor 80 and if the signal is less than that, the capacitor 80 is discharged. For simplification, constant discharge of the capacitor 80 has been incorporated, since the performance changes are minor, but parts savings can be made.

Although FIG. 7 is similar in structure to a full-wave DC power supply, the values of the Charging and lossy resistors 78 and 82 have been carefully selected to emphasize human response and minimize response to pets. The threshold voltage 18 has likewise been optimized for differentiation of target type. An identical circuit to the one shown in FIG. 7 for processing the PIR signal, is used for processing the microwave signal.

It will be apparent to those skilled in the art that modifications to the specific embodiments described herein may be made while still being within the spirit and scope of the present invention. For example, the threshold values may be different or the constant values for the lossy algorithm may be different. In addition, the thresholds may be selected to specifically discriminate against an owner's pet, wherein the micro-controller 10 is able to select between stored values of lossy algorithm constants and the threshold values for detecting an alarm condition. In a system with this ability the owner or installer would be able to input information into the detector to select the proper values for processing the sensor signals.

We claim:

1. A dual-sensing intrusion detection device for detecting an intruder in a volume of space comprising:

a) a Passive Infra Red sensing means for generating a detected PIR signal in response to sensing an intruder in the volume of space, b) PIR processing means for processing the PIR signal and for generating a processed PIR signal, c) a microwave sensing means for generating a detected microwave signal in response to sensing an intruder in the volume of space, d) microwave processing means for processing the detected microwave signal and for generating a processed microwave signal, e) means for generating a PIR difference signal as a function of the detected PIR signal, f) PIR difference signal processing means for processing the difference signal and for generating a processed PIR difference signal, g) means for summing the processed PIR signal, the processed microwave signal, and the processed PIR difference signal to generate a summed signal, and h) means for comparing the summed signal to a sum threshold value to determine if an alarm condition exists.

2. The device of claim 1 wherein the PIR difference signal is generated by determining the difference between a current sample of the detected PIR signal and a prior sample of the detected PIR signal.

3. The device of claim 1 wherein the sum threshold values is selected to distinguish between a human intrusion and an animal presence.

4. The device of claim 1 wherein the sum threshold values is programmable.

5. The device of claim 4 wherein the programmable sum threshold value is selected to customize the dual-sensing intrusion detection device for optimal discrimination between a human intrusion and an animal presence.

6. The device of claim 1 wherein the microwave processing means processes the detected microwave signal at a first rate, and the PIR processing means processes the detected PIR signal at a second rate.

7. The device of claim 6 wherein the first rate is greater than the second rate.

8. The device of claim 1 further comprising means for comparing the detected microwave signal to a minimum microwave threshold value as an additional test to determine if an alarm condition exists.

9. The device of claim 1 further comprising means for comparing the detected PIR signal to a minimum PIR threshold value as an additional test to determine if an alarm condition exists.

10. The device of claim 1 wherein the processed PIR signal is multiplied by a PIR weighting factor prior to being summed.

11. The device of claim 1 wherein the processed difference PIR signal is multiplied by a difference PIR weighting factor prior to being summed.

12. The device of claim 1 wherein the processed microwave signals is multiplied by a microwave weighting factor prior to being summed.

13. The device of claim 1 wherein the processed PIR signal is multiplied by a programmable PIR weighting factor prior to being summed, the processed difference PIR signal is multiplied by a programmable PIR difference weighting factor prior to being summed, and the processed microwave signal is multiplied by a programmable microwave weighting factor prior to being summed.

14. The device of claim 13 wherein the programmable PIR weighting factor, the programmable difference PIR weighting factor, and the programmable microwave weighting factor are selected to customize the dual-sensing intrusion detection device for optimal detection of an intruder in a given volume of space.

15. The device of claim 1 wherein the PIR processing means comprises means for integrating the detected PIR signal to generate the processed PIR signal.

16. The device of claim 15 wherein the means for integrating comprises:

a) a inverting amplifier to generate an inverted detected PIR signal, b) a first diode connected to the detected PIR signal, c) a second diode connected to the inverted detected PIR signal, wherein the first diode and second diode have cathodes tied together to sum the detected PIR signal with the inverted detected PIR signal and to generate a summed PIR signal, d) a first resistor coupled to cathodes of the first and second diodes, e) a capacitor coupled to the first resistor wherein the capacitor is charged by the summed PIR signal, and f) a second resistor coupled to the capacitor to discharge the capacitor.

17. The device of claim 15 wherein the means for integrating comprises a micro-controller means programmed to execute the steps of:

a) converting a sample of the detected PIR signal from an analog value to a digital word, b) subtracting a first PIR sensor threshold value from the digital word, c) determining the absolute value of the digital word minus the first PIR sensor threshold value, d) comparing the absolute value of the digital word minus the first PIR sensor threshold value to a second PIR sensor threshold value, e) generating an increase in the processed PIR signal when the absolute value of the digital word minus the first PIR sensor threshold value is greater than the second PIR sensor threshold value, f) generating a decrease in the processed PIR signal when the absolute value of the digital word minus the first PIR sensor threshold value is not greater than the second PIR sensor threshold value, and g) repeating steps (a)–(f).

18. The device of claim 17 wherein the increase in the processed PIR signal is a percentage of the absolute value of the digital word minus the first PIR sensor threshold value.

19. The device of claim 17 wherein the decrease in the processed PIR signal is a percentage of a prior value of the processed PIR signal.

20. The device of claim 1 wherein the microwave processing means comprises means for integrating the detected microwave signal to generate the processed microwave signal.

21. The device of claim 20 wherein the means for integrating comprises:

g) a inverting amplifier to generate an inverted detected microwave signal, h) a first diode connected to the detected microwave signal, i) a second diode connected to the inverted detected microwave signal, wherein the first diode and second diode have cathodes tied together to sum the detected microwave signal with the inverted detected microwave signal and to generate a summed microwave signal, j) a first resistor coupled to cathodes of the first and second diodes, k) a capacitor coupled to the first resistor wherein the capacitor is charged by the summed microwave signal, and l) a second resistor coupled to the capacitor to discharge the capacitor.

22. The device of claim 20 wherein the means for integrating comprises a micro-controller means programmed to execute the steps of:

a) converting a sample of the detected microwave signal from an analog value to a digital word, b) subtracting a first microwave sensor threshold value from the digital word, c) determining the absolute value of the digital word minus the first microwave sensor threshold value, d) comparing the absolute value of the digital word minus the first microwave sensor threshold value to a second microwave sensor threshold value, e) generating an increase in the processed microwave signal when the absolute value of the digital word minus the first microwave sensor threshold value is greater than the second microwave sensor threshold value, f) generating a decrease in the processed microwave signal when the absolute value of the digital word minus the first microwave sensor threshold value is not greater than the second microwave sensor threshold value, and g) repeating steps (a)–(f).

23. The device of claim 22 wherein the increase in the processed microwave signal is a percentage of the absolute value of the digital word minus the first microwave sensor threshold value.

24. The device of claim 22 wherein the decrease in the processed microwave signal is a percentage of a prior value of the processed microwave signal.

25. The device of claim 1 wherein the difference PIR processing means comprises means for integrating the difference PIR signal to generate the processed difference PIR signal.

26. The device of claim 25 wherein the means for integrating comprises:

a) a inverting amplifier to generate an inverted difference PIR signal, b) a first diode connected to the difference PIR signal, c) a second diode connected to the inverted difference PIR signal, wherein the first diode and second diode have cathodes tied together to sum the difference PIR signal with the inverted difference PIR signal and to generate a summed difference PIR signal, d) a first resistor coupled to cathodes of the first and second diodes, e) a capacitor coupled to the first resistor wherein the capacitor is charged by the summed difference PIR signal, and f) a second resistor coupled to the capacitor to discharge the capacitor.

27. The device of claim 25 wherein the means for integrating comprises a micro-controller means programmed to execute the steps of:

a) subtracting a first PIR difference threshold value from the difference PIR signal, b) determining the absolute value of the difference PIR signal minus the first PIR Difference threshold value, c) comparing the absolute value of the difference PIR signal minus the first PIR Difference threshold value to a second PIR Difference threshold value, d) generating an increase in the processed difference PIR signal when the absolute value of the difference PIR signal minus the first PIR Difference threshold value is greater than the second PIR Difference threshold value, e) generating a decrease in the processed difference PIR signal when the absolute value of the difference PIR signal minus the first PIR Difference threshold value is not greater than the second PIR Difference threshold value, and f) repeating steps (a)–(f).

28. The device of claim 27 wherein the increase in the processed difference PIR signal is a percentage of the absolute value of the difference PIR signal minus the first PIR difference threshold value.

29. The device of claim 27 wherein the decrease in the processed difference PIR signal is a percentage of a prior value of the processed difference PIR signal.

30. A dual-sensing intrusion detection device for detecting an intruder in a volume of space comprising:

a) a Passive Infra Red detector for generating a detected PIR signal in response to sensing an intruder in the volume of space, b) a microwave detector for generating a detected microwave signal in response to sensing an intruder in the volume of space, c) a controller comprising:

i) an A/D converter for digitizing the detected PIR signal and the detected microwave signal, and ii) a processor, iii) memory programmed to cause the processor to execute a repetition of the steps of:

1) sampling the detected microwave signal to generate a digital microwave signal, 2) sampling the detected PIR signal to generate a current digital PIR signal, 3) subtracting a prior digitized PIR signal from the current digital PIR signal to generate a PIR difference signal, 4) summing the digital microwave signal, digital PIR signal, and the PIR difference signal to generate a summed signal, and 5) comparing the summed signal to a sum threshold to determine if an alarm condition exists.

31. The device of claim 30 wherein the memory is further programmed to cause the processor to execute the steps of comparing the digital PIR signal to a minimum PIR threshold value and comparing the digital microwave signal to a minimum microwave threshold value as additional tests for determining if an alarm condition exists.

32. The device of claim 30 wherein the memory is further programmed to cause the processor to execute the steps of: processing the digital PIR signal prior to summing, processing the digital microwave signal prior to summing, and processing the PIR difference signal prior to summing.

33. The device of claim 32 wherein:

the step of processing of the digital PIR signal comprises the steps of:

a) subtracting a first PIR sensor threshold value from the digital PIR signal, b) determining the absolute value of the digital PIR signal minus the first PIR sensor threshold value, c) comparing the absolute value of the digital PIR signal minus the first PIR sensor threshold value to a second PIR sensor threshold value, d) generating an increase in the processed PIR signal when the absolute value of the digital PIR signal minus the first PIR sensor threshold value is greater than the second PIR sensor threshold value, e) generating a decrease in the processed PIR signal when the absolute value of the digital PIR signal minus the first PIR sensor threshold value is not greater than the second PIR sensor threshold value;

and wherein the step of processing of the digital microwave signal comprises the steps of:

f) subtracting a first microwave sensor threshold value from the digital microwave signal, g) determining the absolute value of the digital microwave signal minus the first microwave sensor threshold value, h) comparing the absolute value of the digital microwave signal minus the first microwave sensor threshold value to a second microwave sensor threshold value, i) generating an increase in the processed microwave signal when the absolute value of the digital microwave signal minus the first microwave sensor threshold value is greater than the second microwave sensor threshold value, j) generating a decrease in the processed microwave signal when the absolute value of the digital microwave signal minus the first microwave sensor threshold value is not greater than the second microwave sensor threshold value;

and wherein the step of processing of the difference PIR signal comprises the steps of:

k) subtracting a first PIR difference threshold value from the difference PIR signal, l) determining the absolute value of the difference PIR signal minus the first PIR difference threshold value, m) comparing the absolute value of the difference PIR signal minus the first PIR difference threshold value to a second PIR difference threshold value, n) generating an increase in the processed difference PIR signal when the absolute value of the difference PIR signal minus the first PIR difference threshold value is greater than the second PIR difference threshold value, and o) generating a decrease in the processed difference PIR signal when the absolute value of the difference PIR signal minus the first PIR difference threshold value is not greater than the second PIR difference threshold value.

34. A method of detecting an intruder in a volume of space comprising the steps of:

a) generating from a Passive Infra Red sensing means a detected PIR signal in response to sensing an intruder in the volume of space, b) generating from a microwave sensing means a detected microwave signal in response to sensing an intruder in the volume of space, c) sampling the detected PIR signal to generate a current digital PIR signal, d) sampling the detected microwave signal to generate a digital microwave signal, e) subtracting a prior digitized PIR signal from the current digital PIR signal to generate a PIR difference signal, f) summing the digital PIR signal, the digital microwave signal, and the PIR difference signal to generate a summed signal, g) comparing the summed signal to a sum threshold to determine if an alarm condition exists, and h) repeating steps (a)–(g).

35. The method of claim 34 further comprising the step of comparing the digital PIR signal to a minimum PIR threshold value as an additional test for determining if an alarm condition exists.

36. The method of claim 34 further comprising the step of comparing the digital microwave signal to a minimum microwave threshold value as an additional test for determining if an alarm condition exists.

37. The method of claim 34 wherein the sampling of the detected microwave signal is performed at a first rate and the sampling of the detected PIR signal is performed at a second rate.

38. The method of claim 37 wherein the first rate is greater than the second rate.

39. The method of claim 34 further comprising the steps of multiplying the digital PIR signal by a PIR weighting factor, multiplying the digital microwave signal by a microwave weighting factor, and multiplying the difference PIR signal by a difference PIR weighting factor prior to being summed.

40. The method of claim 34 further comprising the step of processing the digital PIR signal prior to summing.

41. The method of claim 34 further comprising the step of processing the digital microwave signal prior to summing.

42. The method of claim 34 further comprising the step of processing the difference PIR signal prior to summing.

43. The method of claim 40 wherein the step of processing the digital PIR signal comprises the steps of:

subtracting a first PIR sensor threshold value from the digital PIR signal, determining the absolute value of the digital PIR signal minus the first PIR sensor threshold value, comparing the absolute value of the digital PIR signal minus the first PIR sensor threshold value to a second PIR sensor threshold value, generating an increase in the processed PIR signal when the absolute value of the digital PIR signal minus the first PIR sensor threshold value is greater than the second PIR sensor threshold value, and generating a decrease in the processed PIR signal when the absolute value of the digital PIR signal minus the first PIR sensor threshold value is not greater than the second PIR sensor threshold value.

44. The method of claim 41 wherein the step of processing of the digital microwave signal comprises the steps of:

subtracting a first microwave sensor threshold value from the digital microwave signal, determining the absolute value of the digital microwave signal minus the first microwave sensor threshold value, comparing the absolute value of the digital microwave signal minus the first microwave sensor threshold value to a second microwave sensor threshold value, generating an increase in the processed microwave signal when the absolute value of the digital microwave signal minus the first microwave sensor threshold value is greater than the second microwave sensor threshold value, and generating a decrease in the processed microwave signal when the absolute value of the digital microwave signal minus the first microwave sensor threshold value is not greater than the second microwave sensor threshold value.

45. The method of claim 42 wherein the step of processing the difference PIR signal comprises the steps of:

subtracting a first PIR difference threshold value from the difference PIR signal, determining the absolute value of the difference PIR signal minus the first PIR difference threshold value, comparing the absolute value of the difference PIR signal minus the first PIR difference threshold value to a second PIR difference threshold value, generating an increase in the processed difference PIR signal when the absolute value of the difference PIR signal minus the first PIR difference threshold value is greater than the second PIR difference threshold value, and generating a decrease in the processed difference PIR signal when the absolute value of the difference PIR signal minus the first PIR difference threshold value is not greater than the second PIR difference threshold value.

46. A dual-sensing intrusion detection device for detecting an intruder in a volume of space comprising:

a) a passive infra red sensing means for generating a detected PIR signal in response to sensing an intruder in the volume of space, b) PIR integration means for integrating the PIR signal and for generating a processed PIR signal, comprising:

i) A first inverting amplifier to generate an inverted PIR signal, ii) a first diode connected to the PIR signal, iii) a second diode connected to the inverted PIR signal, wherein the first diode and second diode have cathodes tied together to sum the PIR signal with the inverted PIR signal and to generate a summed PIR signal, iv) a first resistor coupled to cathodes of the first and second diodes, v) a first capacitor coupled to the first resistor wherein the first capacitor is charged by the summed PIR signal, and vi) a second resistor coupled to the capacitor to discharge the first capacitor, c) A microwave sensing means for generating a detected microwave signal in response to sensing an intruder in the volume of space, d) Microwave integration means for integrating the detected microwave signal and for generating a processed microwave signal, comprising:

i) a second inverting amplifier to generate an inverted microwave signal, ii) a third diode connected to the microwave signal, iii) a fourth diode connected to the inverted microwave signal, wherein the third diode and fourth diode have cathodes tied together to sum the microwave signal with the inverted microwave signal and to generate a summed microwave signal, iv) a third resistor coupled to cathodes of the third and fourth diodes, v) a second capacitor coupled to the third resistor wherein the second capacitor is charged by the summed microwave signal, and vi) a fourth resistor coupled to the second capacitor to discharge the second capacitor, e) Means for summing the processed PIR signal and the processed microwave signal to generate a summed signal, and f) Means for comparing the summed signal to a sum threshold value to determine if an alarm condition exists.

47. The device of claim 46 wherein the sum threshold value is selected to distinguish between a human intrusion and an animal presence.

48. The device of claim 46 further comprising means for comparing the detected microwave signal to a minimum microwave threshold value as an additional test to determine if an alarm condition exists.

49. The device of claim 46 further comprising means for comparing the detected PIR signal to a minimum PIR threshold value as an additional test to determine if an alarm condition exists.

50. A dual-sensing intrusion detection device for detecting an intruder in a volume of space comprising:

a) a passive infra red sensing means for generating a detected PIR signal in response to sensing an intruder in the volume of space, b) PIR integration means for integrating the PIR signal and for generating a processed PIR signal, comprising a microprocessor programmed to execute the steps of:

i) subtracting a first PIR sensor threshold value from the PIR signal, ii) determining the absolute value of the PIR signal minus the first PIR sensor threshold value, iii) comparing the absolute value of the PIR signal minus the first PIR sensor threshold value to a second PIR sensor threshold value, iv) generating an increase in the processed PIR signal when the absolute value of the PIR signal minus the first PIR sensor threshold value is greater than the second PIR sensor threshold value, v) generating a decrease in the processed PIR signal when the absolute value of the PIR signal minus the first PIR sensor threshold value is not greater than the second PIR sensor threshold value, and vi) repeating steps (i)–(v).

c) A microwave sensing means for generating a detected microwave signal in response to sensing an intruder in the volume of space, d) Microwave integration means for integrating the detected microwave signal and for generating a processed microwave signal, comprising:

i) subtracting a first microwave sensor threshold value from the microwave signal, ii) determining the absolute value of the microwave signal minus the first microwave sensor threshold value, iii) comparing the absolute value of the microwave signal minus the first microwave sensor threshold value to a second microwave sensor threshold value, iv) generating an increase in the processed microwave signal when the absolute value of the microwave signal minus the first microwave sensor threshold value is greater than the second microwave sensor threshold value, v) generating a decrease in the processed microwave signal when the absolute value of the microwave signal minus the first microwave sensor threshold value is not greater than the second microwave sensor threshold value, and vi) repeating steps (i)–(v).

e) Means for summing the processed PIR signal and the processed microwave signal to generate a summed signal, and f) Means for comparing the summed signal to a sum threshold value to determine if an alarm condition exists.

51. The device of claim 50 wherein the sum threshold value is selected to distinguish between a human intrusion and an animal presence.

52. The device of claim 50 wherein the sum threshold value is programmable.

53. The device of claim 50 further comprising means for comparing the detected microwave signal to a minimum microwave threshold value as an additional test to determine if an alarm condition exists.

54. The device of claim 50 further comprising means for comparing the detected PIR signal to a minimum PIR threshold value as an additional test to determine if an alarm condition exists.

55. The device of claim 50 wherein the processed microwave signal is multiplied by a microwave weighting factor prior to being summed with the processed PIR signal.

56. The device of claim 50 wherein the processed PIR signal is multiplied by a PIR weighting factor prior to being summed with the processed microwave signal.

* * * * *